US007097017B1

(12) United States Patent
LaCrosse et al.

(10) Patent No.: US 7,097,017 B1
(45) Date of Patent: Aug. 29, 2006

(54) TRAVEL SUITCASE WITH SEAT

(76) Inventors: Wills LaCrosse, 3455 Peachtree Indus. Blvd., Duluth, GA (US) 30096; Cecil Alexander, 2677 Rivers Rd., Atlanta, GA (US) 30305

( * ) Notice: Subject to any disclaimer, the term of this patent is extended or adjusted under 35 U.S.C. 154(b) by 0 days.

(21) Appl. No.: 11/244,238

(22) Filed: Oct. 6, 2005

(51) Int. Cl.
*A45C 9/00* (2006.01)
*A45C 5/14* (2006.01)
*A45C 13/34* (2006.01)

(52) U.S. Cl. ..... 190/8; 190/18 A; 383/4; 297/17.1

(58) Field of Classification Search ..... 189/1, 189/2, 8, 12 A, 18 A; 280/37, 43.17, 47.18, 280/47.24, 47.25, 47.38; 297/17, 129, 217.1; 190/11, 39, 115; 383/4; 16/110.1, 111, 113.1
See application file for complete search history.

(56) References Cited

U.S. PATENT DOCUMENTS 3,376,954 A * 4/1968 Neptune ..... 188/69
3,557,916 A * 1/1971 Stowell ..... 190/11
3,809,202 A * 5/1974 Tyszkiewicz ..... 194/247
4,314,624 A * 2/1982 Royet ..... 190/18 A
4,412,604 A 11/1983 Bell et al.
4,460,188 A * 7/1984 Maloof ..... 280/30
4,575,109 A * 3/1986 Cowdery ..... 280/37
5,154,265 A * 10/1992 Capistrant ..... 190/18 A
5,273,307 A * 12/1993 Jarke et al. ..... 280/643
5,343,988 A * 9/1994 Bartsch et al. ..... 190/18 A
5,421,637 A * 6/1995 Lemburg ..... 297/188.01
5,507,508 A 4/1996 Liang
5,515,954 A * 5/1996 Nordstrom ..... 190/18 A
5,813,503 A * 9/1998 Chang ..... 190/18 A
5,941,352 A * 8/1999 Lee ..... 190/11
6,016,893 A * 1/2000 Chen et al. ..... 190/1
6,213,265 B1 * 4/2001 Wang ..... 190/11
6,237,734 B1 5/2001 Chen
6,241,313 B1 * 6/2001 Lenz et al. ..... 297/217.1
6,264,078 B1 * 7/2001 Bilang ..... 224/155
6,471,019 B1 * 10/2002 Miller ..... 190/11
6,644,447 B1 11/2003 Pohl
2002/0063072 A1 5/2002 Pham
2002/0180247 A1 * 12/2002 Lombardi ..... 297/217.1

(Continued)

FOREIGN PATENT DOCUMENTS

DE 3339913 A1 * 5/1985

(Continued)

*Primary Examiner*—Sue A. Weaver
(74) *Attorney, Agent, or Firm*—Welsh & Flaxman LLC

(57) ABSTRACT

A suitcase including a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface. The suitcase also includes a seat pivotally secured to rotate about the top rear edge of the main body for pivotal motion from a storage position along the rear surface to a use position along the top surface. The seat includes a seat bottom. Wheels are coupled along the bottom rear edge, wherein the wheels are positioned such that they only engage the support surface when the suitcase is tipped from a vertical orientation exceeding a predetermined angle. A seat support structure supports the seat for rotation between its use position and its storage position. The seat support structure includes first and second seat swing arms secured to opposite sides of the suitcase. A braking device ensures the suitcase does not inadvertently roll when an individual is sitting thereon by securely locking the wheels from turning when the seat is being used.

19 Claims, 5 Drawing Sheets

U.S. PATENT DOCUMENTS

2003/0132078 A1* 7/2003 Godshaw ..... 190/18 A
2004/0066069 A1* 4/2004 Caldana ..... 297/250.1
2004/0251717 A1 12/2004 Tamura
2005/0098402 A1* 5/2005 Cohen ..... 190/12 A
2005/0150733 A1* 7/2005 Chen ..... 190/115
2005/0194226 A1* 9/2005 Wang et al. ..... 190/8

FOREIGN PATENT DOCUMENTS

FR 2834431 A1 * 7/2003
WO WO 2004100699 A1 * 11/2004

* cited by examiner

TRAVEL SUITCASE WITH SEAT

BACKGROUND OF THE INVENTION

1. Field of the Invention

The invention relates to a travel suitcase. More particularly, the invention relates to a travel suitcase having a built-in seat and/or stand.

2. Description of the Prior Art

With the development of heightened security at airports, trains, and other transportation facilities, the waiting time for people as they board vehicles or wait to pass through security has substantially increased. As such, many people stand around for long periods of time with no place to rest their legs as they move, oftentimes, slowly through the lines.

Various suitcases have been developed with stands and/or seats integrated therewith. However, each of these suitcases exhibits limitations that have prevented the general public from accepting such suitcases and making these suitcases commonplace within the marketplace. With this in mind, the present invention endeavors to provide a travel suitcase with a built-in seat and suitcase stand. The present travel suitcase is convenient, durable and easy to use, while also offering manufacturing capabilities that allow for a reasonable purchase price.

SUMMARY OF THE INVENTION

The present invention is directed to a suitcase including a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface. The suitcase also includes a seat pivotally secured to rotate about the top rear edge of the main body for pivotal motion from a storage position along the rear surface to a use position along the top surface. The seat includes a seat bottom. Wheels are coupled along the bottom rear edge, wherein the wheels are positioned such that they only engage the support surface when the suitcase is tipped from a vertical orientation exceeding a predetermined angle.

It is also an object of the present invention to provide a suitcase including a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface. The suitcase also includes a seat pivotally secured to rotate about the top rear edge of the main body for pivotal motion from a storage position along the rear surface to a use position along the top surface. The seat includes a seat bottom. A seat support structure supports the seat for rotation between its use position and its storage position. The seat support structure includes first and second seat swing arms secured to opposite sides of the suitcase.

It is another object of the present invention to provide a suitcase including a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface. The suitcase also includes a seat pivotally secured to rotate about the top rear edge of the main body for pivotal motion from a storage position along the rear surface to a use position along the top surface. The seat includes a seat bottom. A braking device ensures the suitcase does not inadvertently roll when an individual is sitting thereon by securely locking the wheels from turning when the seat is being used.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
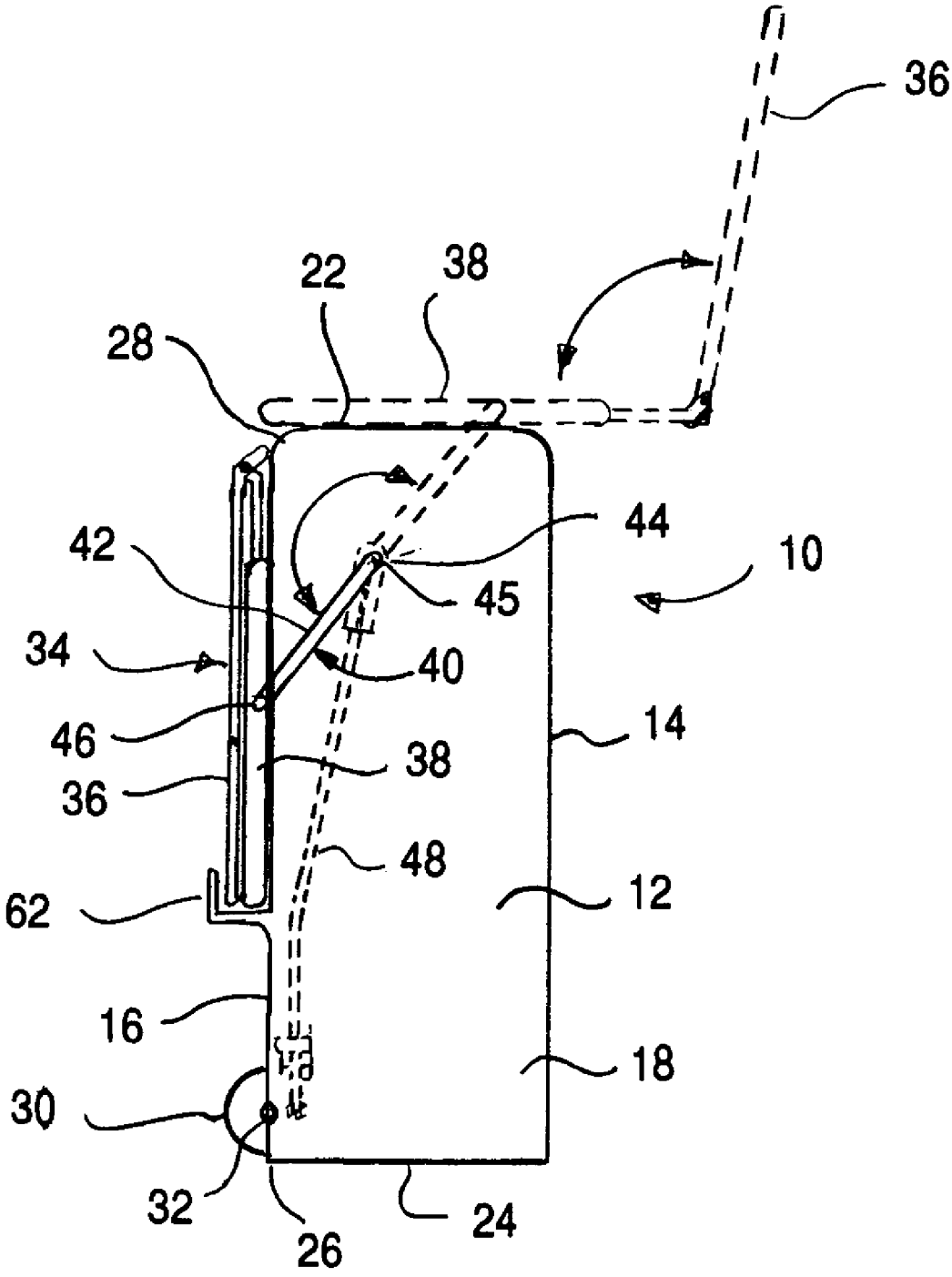
FIG. 1 is a side view of the present travel suitcase.
Figure 2:
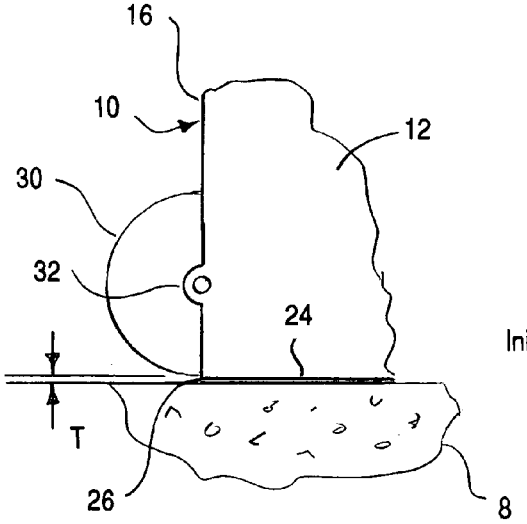
FIG. 2 is a detailed side view of the wheel with the suitcase in a vertical orientation.
Figure 3:
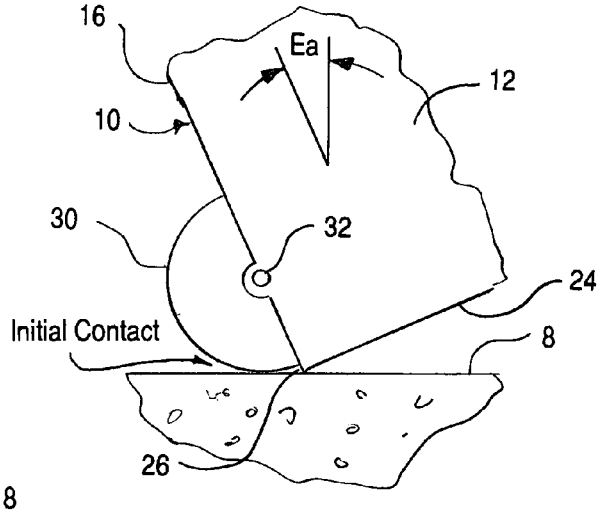
FIG. 3 is a detailed side view of the wheel with the suitcase in a tilted orientation.
Figure 4:
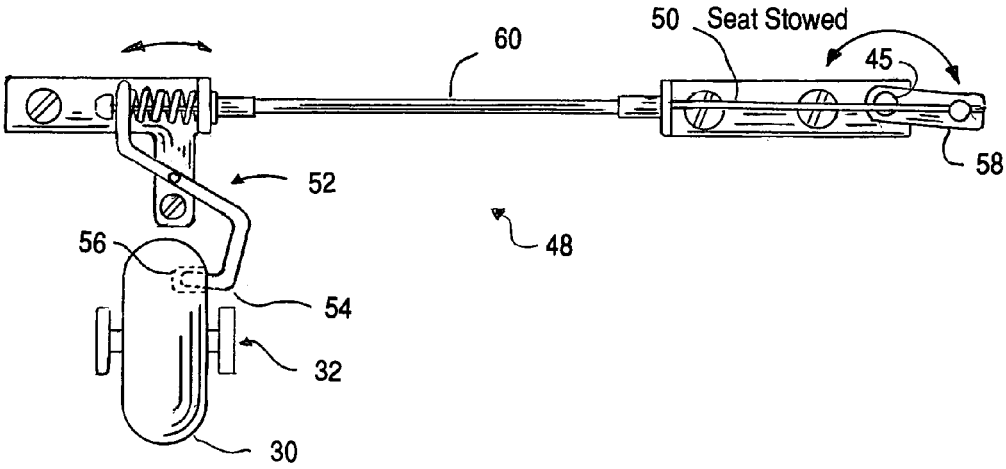
FIG. 4 is a detailed view of the wheel locking mechanism employed in accordance with the present invention.
Figure 5:
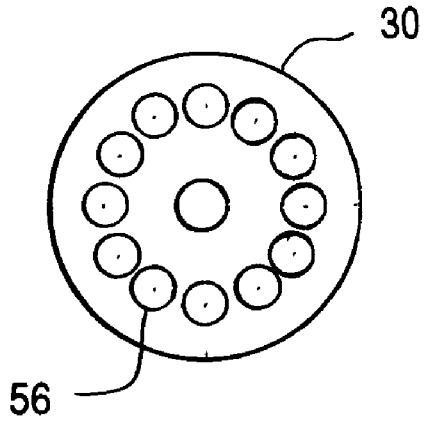
FIG. 5 is a detail side view of the wheels employed in accordance with the present invention.
Figure 6:
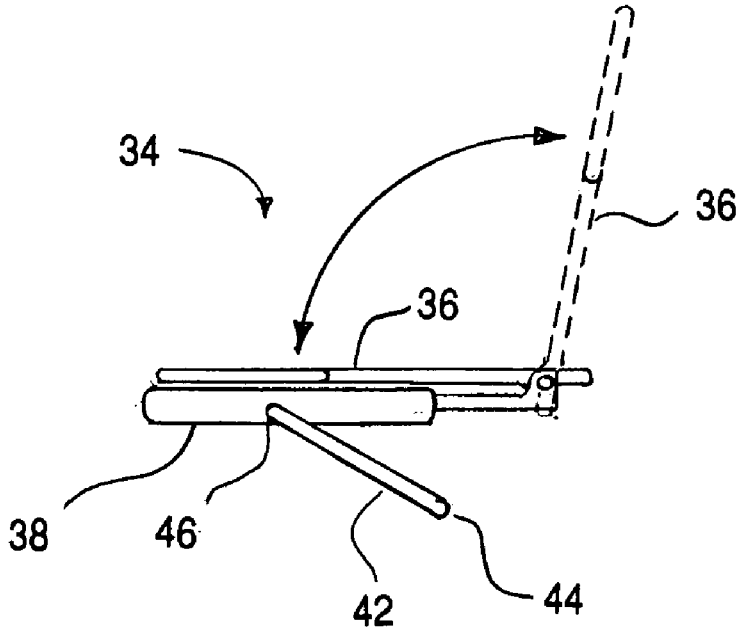
FIG. 6 is a detailed side view of the seat in accordance with the present invention.
Figure 7:
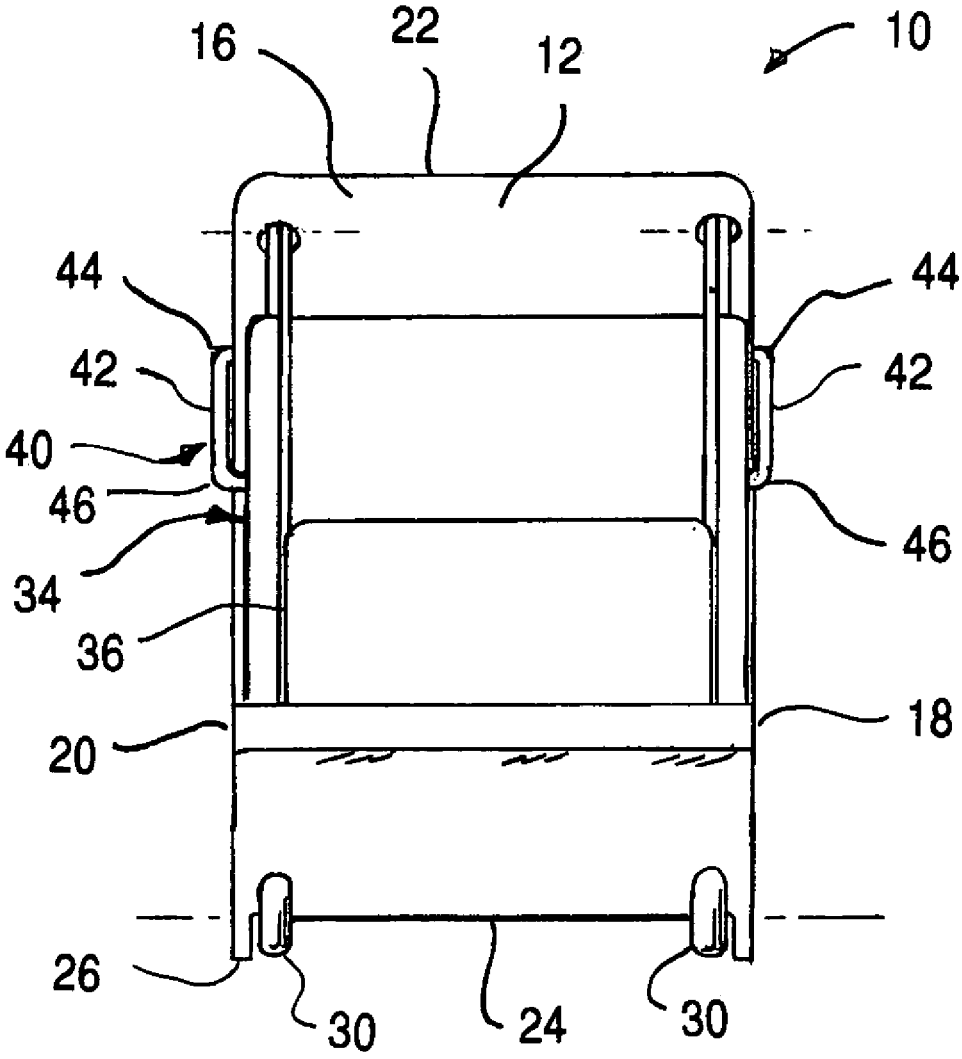
FIG. 7 is a rear view of the present suitcase.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to FIGS. 1–8, the present travel suitcase 10 is disclosed. The travel suitcase 10 includes a main body 12 having a front surface 14, rear surface 16, first and second side surfaces 18, 20, a top surface 22 and a bottom surface 24. The main body 12 is further provided with a bottom rear edge 26 at the meeting point of the bottom surface 24 and the rear surface 16. The main body 12 also includes a top rear edge 28 adjacent to the meeting point of the top surface 22 and the rear surface 16. The suitcase 10 is provided with two wheels 30 along the bottom rear edge 26 thereof. In accordance with a preferred embodiment of the present invention, the wheels are conventional polymer wheels, although other wheel structures may be used without departing from the spirit of the present invention.

The wheels 30 allow the suitcase 10 to be pulled around like current carry-on travel cases. However, the wheels 30 are positioned such that they only engage the ground (or other support surface) 8 when the suitcase 10 is tipped from a vertical orientation exceeding a predetermined angle. The angle is determined based upon the diameter of the wheels 30 and the distance the wheel axis 32 is from the bottom surface 26 of the suitcase 10, wherein the distance the wheel axis 32 is from the bottom surface 26 is slightly greater than the radius of the wheels 30. In accordance with a preferred embodiment, the wheels 30 engage the support surface 8 when the suitcase 10 is tilted to an angle of approximately 10 degrees. The position of the wheels 30 is such that they only engage the support surface 8 when tipped from a vertical orientation to ensure the wheels 30 do not touch the support surface 8 when an individual is sitting upon the built-in seat 34 of the suitcase 10.

The seat 34 is pivotally secured to rotate about the top rear edge 28 of the main body 12 for pivotal motion from a storage position shown in solid lines to a use position shown in broken lines. The seat 34 includes an optional seat back 36 and a seat bottom 38. The seat back 36 and seat bottom 38 are pivotally attached such that the seat 34 may be expanded by pivoting the seat back 36 away from the seat bottom 38 to create a substantially L-shaped support surface when the seat 34 is in its use position. The seat bottom 38 and the seat back 36 are further provided with a cushioning material adding comfort to the present invention.

Rotation of the seat 34 between a use position and a storage position is achieved via a seat support structure 40. The seat support structure 40 includes a pair of seat swing arms 42 which are secured to the seat 34 for facilitating movement thereof between the storage position and the use position. In accordance with a preferred embodiment, first and second seat swing arms 42 are secured to opposite sides of the suitcase. Each seat swing arm 42 includes a first end 44 and a second end 46. The first end 44 of each seat swing arm 42 is pivotally secured to either the first or second side wall 18, 20 of the main body 12 by a pivot pin 45, while the second end 46 of each seat swing arm 42 is pivotally secured to the seat bottom 38 along opposite sides thereof. In this way, the seat 34 may be rotated upwardly from its storage position away from the back surface 16 of the main body 12 toward the top surface 22 of the main body 12 under the support and guidance of the seat swing arms 42. Those skilled in the art will appreciate the dimensions required to create the disclosed linkage system of the seat support structure 40 and the disclosure will, therefore, not go into substantial detail regarding the specific dimensions required to create the present seat support structure 40.

As discussed above, the wheels 30 are positioned such that they do not touch the ground unless the suitcase 10 is tipped from a vertical orientation. A braking device 48 is provided for ensuring that the suitcase 10 does not inadvertently roll when an individual is sitting thereon by securely locking the wheels 30 from turning when the seat 34 is being used. The braking device 48 is similar to the hand brakes commonly found on a bicycle and uses a flexible connecting cable 50 linked to the swing arm 42 by a lever 58 to lock the wheels 30 when the seat 34 is in its use position.

In particular, the seat swing arm 42 is linked to a lever 58 such that the lever 58 is rotated when the seat 34 is moved between its use position and its storage positioned. The lever 58 is in turn linked to a cable 50 running from the pivot pin 45 of the swing arm 42 to a position adjacent the wheels 30. The cable 50 is covered in a housing 60 as it extends from the swing arm 42 to the wheels 30. The opposite end of the cable 50 is linked to the locking lever 52, which is actuated upon movement of the seat 34. When the seat 34 is flipped up to its use position, the cable 50 is released from tension and the locking lever 52 of the brake assembly 48 is engaged to force the brake tong 54 to a closed position. In this closed position the end of the brake tong 54 enters matching hole 56 in the side of the wheel 30 to prevent rotation thereof. When the seat swing arm 42 is rotated downwardly to its storage position (and the pivot pin 45 is also rotated), the cable 50 is tensioned by the lever 58 coupled to the seat swing arm 42.

The seat 34 may be secured in its storage position by any means known in the art. Further, in a preferred embodiment, secure positioning of the seat 34 in its storage position is provided by a L-shaped flange 62 extending from the rear surface 16 of the main body 12. The L-shaped flange 62 is shaped and dimensioned to support the front surface of the folded seat 34, that is, to support the front ends of the seat back 36 and seat bottom 38. In yet another preferred embodiment, the seat is secured by hook and loop fastener strips extending from the rear surface 16 of the main body 12.

Figure 8:
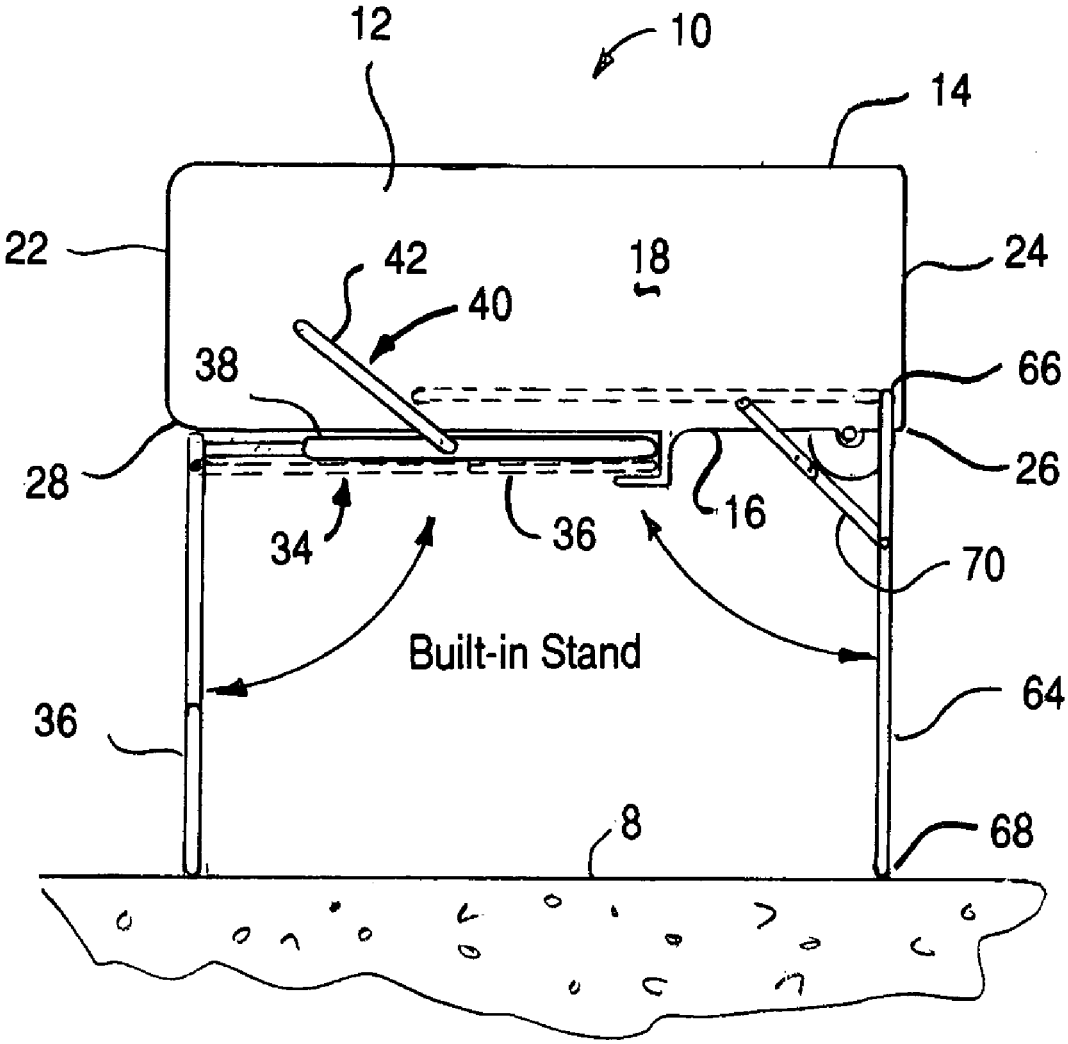
FIG. 8 is a side view showing the suitcase oriented for use as a stand.

With reference to FIG. 8, the suitcase 10 is provided with added versatility through the additional inclusion of mounting legs 64 pivotally secured along the bottom rear edge 26 of the main body 12 for pivotal motion to a supporting position. When the mounting legs 64 and seat 34 are pivoted to the orientation shown in FIG. 8, the suitcase 10 may be utilized as a horizontal stand for access to clothing stored within the suitcase 10, as well as supporting people and other objects. More particularly, each of the mounting legs 64 includes a first end 66 and a second end 68. The first end 66 of each mounting leg 64 is pivotally secured to a side wall 18, 20 adjacent the bottom rear edge 26 of the main body 12. The second end 68 of the mounting legs 64 are shaped and dimensioned for engaging the support surface 8. Controlled pivoting of the mounting legs 64 is achieved by providing each of the mounting legs 64 with a conventional locking bracket 70.

As should be appreciated from the preceding disclosure and the drawings, the present suitcase provides an apparatus that can be converted into a seat to allow a person to sit down instead of standing. This conversion is readily achieved and convenient for users. In addition, the suitcase is provided with an additional mounted leg allowing for conversion of the suitcase to a suitcase for those who prefer not to place their suitcase on a table or bed during access.

While the preferred embodiment has been shown and described, it will be understood that there is no intent to limit the invention by such disclosure, but rather, is intended to cover all modifications and alternate constructions falling within the spirit and scope of the invention.

The invention claimed is:

1. A suitcase, comprising:

a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface;

a seat having a top seat surface, a bottom, a front edge and a rear edge, the seat is pivotally secured to rotate about the top rear edge of the main body for pivotal motion from a storage position along the rear surface to a use position located on and supported by the top surface of the main body;

a seat support structure supporting the seat for rotation between its use position on said top surface and its storage position adjacent said rear surface; a pivot centrally located on each of the first and second side surfaces, the seat support structure includes first and second seat swing arms secured to the pivot on the first and second side surfaces of the suitcase, wherein each seat swing arm includes a first end and a second end, the first end of each seat swing arm is pivotally secured to the pivot on the first or second side surfaces of the main body, while the second end of each seat swing arm is pivotally secured proximately midway between the front edge and the rear edge to the seat bottom along opposite sides thereof in a manner permitting the seat to be selectively rotated upwardly from its storage position along the rear surface of the main body toward the top surface of the main body; and, wheels coupled along the bottom rear edge, wherein the wheels are positioned such that they only engage the support surface when the suitcase is tipped from a vertical orientation exceeding a predetermined angle.

2. The suitcase according to claim 1, wherein the seat includes a seat back and the seat back and seat bottom are pivotally coupled to each other such that the seat may be expanded to create a back support surface when the seat is in its use position.

3. The suitcase according to claim 1, wherein the distance a wheel axis is from the bottom surface is slightly greater than the radius of the wheels.

4. The suitcase according to claim 1, further including a braking device which ensures the suitcase does not inadvertently roll when an individual is sitting thereon by securely locking the wheels from turning when the seat is being used.

5. The suitcase according to claim 4, wherein the braking device includes a flexible cable linking the seat to a locking lever which selectively engages the wheels.

6. The suitcase according to claim 1, further including mounting legs pivotally secured along the bottom rear edge of the main body for selective pivotal motion to a supporting position, and wherein the seat may be rotated to a support position extending substantially perpendicularly to the rear surface of the main body.

7. A suitcase, comprising:

a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface;

a seat having a top seat surface, a bottom, a front edge and a rear edge, the seat is pivotally secured to rotate about the top rear edge of the main body for pivotal motion from a storage position along the rear surface to a use position located on and supported by the top surface of the main body;

a seat support structure supporting the seat for rotation between its use position on said top surface and its storage position adjacent said rear surface; a pivot centrally located on each of the first and second side surfaces, the seat support structure includes first and second seat swing arms secured to the pivot on the first and second side surfaces of the suitcase, wherein each seat swing arm includes a first end and a second end, the first end of each seat swing arm is pivotally secured to the pivot on the first or second side surfaces of the main body, while the second end of each seat swing arm is pivotally secured proximately midway between the front edge and the rear edge to the seat bottom along opposite sides thereof in a manner permitting the seat to be selectively rotated upwardly from its storage position along the rear surface of the main body toward the top surface of the main body.

8. The suitcase according to claim 7, wherein the seat includes a seat back and the seat back and seat bottom are pivotally coupled such that the seat may be expanded to create a back support surface when the seat is in its use position.

9. The suitcase according to claim 7, further including wheels coupled along the bottom rear edge thereof, wherein the distance a wheel axis is from the bottom surface is slightly greater than the radius of the wheels.

10. The suitcase according to claim 9, further including a braking device which ensures the suitcase does not inadvertently roll when an individual is sitting thereon by securely locking the wheels from turning when the seat is being used.

11. The suitcase according to claim 10, wherein the braking device includes a flexible cable linking the seat to a locking lever which selectively engages the wheels.

12. The suitcase according to claim 7, further including mounting legs pivotally secured along the bottom rear edge of the main body for selective pivotal motion to a supporting position, and wherein the seat may be rotated to a support position extending substantially perpendicularly to the rear surface of the main body.

13. A suitcase, comprising:

a main body having a front surface, rear surface, first and second side surfaces, a top surface and a bottom surface, a bottom rear edge at the meeting point of the bottom surface and the rear surface as well as a top rear edge adjacent to the meeting point of the top surface and the rear surface;

a seat having a top seat surface, a bottom, a front edge and a rear edge, the seat is pivotally secured to rotate about the top rear edge of the main body for pivotal motion from a storage position along the rear surface to a use position located on and supported by the top surface of the main body;

a seat support structure supporting the seat for rotation between its use position on said top surface and its storage position adjacent said rear surface; a pivot centrally located on each of the first and second side surfaces, the seat support structure includes first and second seat swing arms secured to the pivot on the first and second side surfaces of the suitcase, wherein each seat swing arm includes a first end and a second end, the first end of each seat swing arm is pivotally secured to the pivot on the first or second side surfaces of the main body, while the second end of each seat swing arm is pivotally secured proximately midway between the front edge and the rear edge to the seat bottom along opposite sides thereof in a manner permitting the seat to be selectively rotated upwardly from its storage position along the rear surface of the main body toward the top surface of the main body; and, a braking device which ensures the suitcase does not inadvertently roll when an individual is sitting thereon by securely locking wheels from turning when the seat is being used.

14. The suitcase according to claim 13, wherein the seat includes a seat back and the seat back and seat bottom are pivotally coupled such that the seat may be expanded to create a back support surface when the seat is in its use position.

15. The suitcase according to claim 13, further including wheels are coupled along the bottom rear edge thereof, wherein the distance a wheel axis is from the bottom surface is slightly greater than the radius of the wheels.

16. The suitcase according to claim 13, wherein the braking device includes a flexible cable linking the seat to a locking lever which selectively engages the wheels.

17. The suitcase according to claim 16, wherein the wheels include apertures for engagement with the locking lever.

18. The suitcase according to claim 13, further including mounting legs pivotally secured along the bottom rear edge of the main body for selective pivotal motion to a supporting position.

19. The suitcase according to claim 18, wherein the seat may be rotated to a support position extending substantially perpendicularly to the rear surface of the main body.

* * * * *